US007934288B2

(12) United States Patent
Waldman

(10) Patent No.: US 7,934,288 B2
(45) Date of Patent: May 3, 2011

(54) FINGER ERASER

(76) Inventor: Danielle Waldman, New York, NY (US)

( * ) Notice: Subject to any disclaimer, the term of this patent is extended or adjusted under 35 U.S.C. 154(b) by 827 days.

(21) Appl. No.: 11/869,135

(22) Filed: Oct. 9, 2007

(65) Prior Publication Data

US 2009/0092957 A1 Apr. 9, 2009

(51) Int. Cl.
*B25F 1/00* (2006.01)

(52) U.S. Cl. ..... 15/425; 15/227; 15/443; 401/7; 434/408; 434/417

(58) Field of Classification Search ..... 15/227, 15/425, 443, 105.51; 401/7, 8; 434/408–419
See application file for complete search history.

(56) References Cited

U.S. PATENT DOCUMENTS 3,735,442 A 5/1973 Lukas
4,733,410 A * 3/1988 Glotkin ..... 2/21
5,320,531 A * 6/1994 Delizo-Madamba ..... 433/136
5,933,863 A 8/1999 Monsue
6,810,530 B2 11/2004 Bryant, Sr.
7,086,094 B1 8/2006 Ismailyan
7,127,771 B2 * 10/2006 McDevitt et al. ..... 15/227
7,552,501 B2 * 6/2009 Yang et al. ..... 15/227
7,861,353 B2 * 1/2011 Lewis et al. ..... 15/104.002
2003/0213081 A1 11/2003 Garcia

FOREIGN PATENT DOCUMENTS

JP 2005096335 A * 4/2005

* cited by examiner

*Primary Examiner* — Shay L Karls
(74) *Attorney, Agent, or Firm* — Gottlieb, Rackman & Reisman, P.C.

(57) ABSTRACT

An eraser for use in erasing markings on boards, such as chalk boards and white boards, is provided. The eraser comprises a form-fitted finger element made from a knitted or felted fabric. The finger element consists of a tubular member that defines a longitudinally extending finger passage. The tubular member has one open end and one closed end. The open end is sized such that the finger of the eraser user is insertable through the open end, so that at least a portion of the finger is received within the finger element passage.

14 Claims, 2 Drawing Sheets

FINGER ERASER

BACKGROUND OF THE INVENTION

This application is directed to an educational tool, and more particularly, to an eraser element for use in erasing markings on chalk boards and white boards.

In many elementary school classrooms, each student often has an individual chalkboard or whiteboard in order to help them to respond, in written form, to questions posed by the teacher. Writing on a chalk board or white board is carried out by using either chalk (for the chalk board) or a marker (for the white board) and then erasing what has been written by means of some type of eraser mechanism.

In some situations, the student will erase by using his or her finger to clean the board. However, this is disadvantageous since the student's fingers will likely become black from erasing what the student had written with the marker.

While there are various eraser products available in the marketplace, none is desirable for a student who has behavioral issues or who is otherwise difficult to control. For example, miniature erasers, smaller versions of the ones used on chalk boards, are readily available, which enables each student to have his/her own personal eraser. However, the use of a personal eraser is disadvantageous as students are likely to throw them around in a classroom, distracting the student from his work and causing the teacher to have to frequently retrieve and clean up the thrown eraser.

Another option is to use cut-up pieces of felt. However, this is less than desirable since the felt material can be easily lost by the young student.

A further option is to use erasable markers that have an eraser built in on the cap. The problem with using such erasable markers is that these are substantially more expensive to purchase than ordinary markers. In the school setting, young students often do not replace the cap on the marker, causing the marker to dry out. Therefore, the marker has to be replaced often, and if it is more expensive, the cost incurred is substantially increased.

Accordingly, it would be desirable to provide an eraser mechanism for boards such as chalk boards and white boards that overcomes the above disadvantages.

SUMMARY OF THE INVENTION

Generally speaking, in accordance with the invention, an eraser for use in erasing markings on boards, such as chalk boards and white boards, is provided. The eraser comprises a form-fitted finger element made from a knitted or felted fabric. The finger element consists of a tubular member that defines a longitudinally extending finger passage. The tubular member has one open end and one closed end. The open end is sized such that the finger of the eraser user is insertable through the open end, so that at least a portion of the finger is received within the finger element passage.

Preferably, the open end of the finger element is formed with an annular elastic member in order to prevent the finger element from sliding off one's finger when the finger element is being worn.

The finger element of the invention may be made by cutting off the fingers from conventional knit gloves, or it may be specially constructed. Each child in a classroom setting receives a single finger eraser, which they typically keep on one of their fingers of their non-writing hand while writing on the white board with an erasable marker.

When students are writing on a white board, the inventive finger eraser fits snugly on a finger of the opposite hand of a student. This provides a place to locate the finger eraser when it is not being used to erase markings on the board. This is contrast to conventional eraser products, which have to be placed next to the student, either on the floor or on a table when not in use. In addition, the finger eraser of the invention stays on the student's finger at all times, making it easier for use in the erasing process.

Alternatively, when the finger eraser is not being used, it can be placed over the end of the marker for storage purposes.

Furthermore, the inventive finger eraser can provide instructional value to the student. The student can wear the finger eraser on the index finger of the writing hand and trace over the letters/words that have been written on the board. This can provide for multi-sensory instruction, which is extremely beneficial for struggling students.

Accordingly, it is an object of the invention to provide an improved eraser mechanism for use in erasing markings on boards such as chalk boards and white boards.

Another object of the invention is to provide an improved eraser mechanism that is suitable to be worn on the finger of an individual.

Yet a further object of the invention is to provide an improved eraser mechanism which is not likely to be thrown or lost by a student.

Still another object of the invention is to provide and improved eraser mechanism for enhancing the learning process.

A further object of the invention is an improved eraser mechanism that can be worn while writing on a board.

Other objects and advantages of the invention will, in part, be obvious and will, in part, be apparent from the following description.

The invention accordingly comprises an article of manufacture possessing the features, properties and relation of elements which will be exemplified in the description herein and the scope of the invention will be found in the claims.

BRIEF DESCRIPTION OF THE DRAWINGS

For a fuller understanding of the invention, reference is made to the following description, taken into connection with the accompanying drawings, in which.

DETAILED DESCRIPTION OF THE PREFERRED EMBODIMENT

Figure 2:
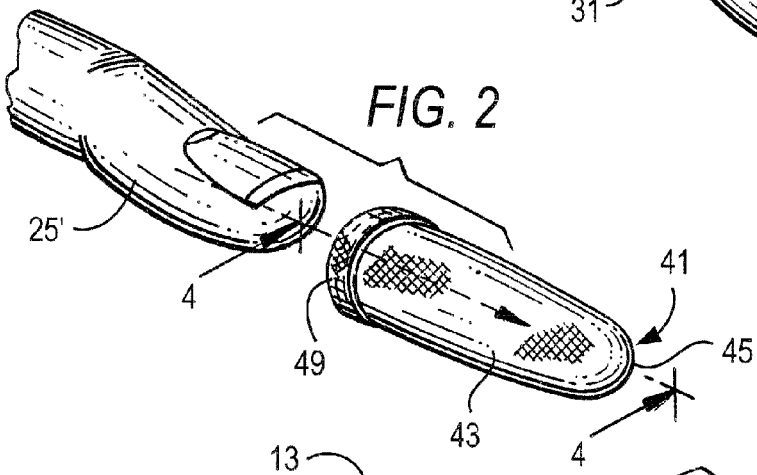
FIG. 2 is an exploded perspective view showing the index finger of the non-dominant hand receiving the finger eraser of the invention.
Figure 3:
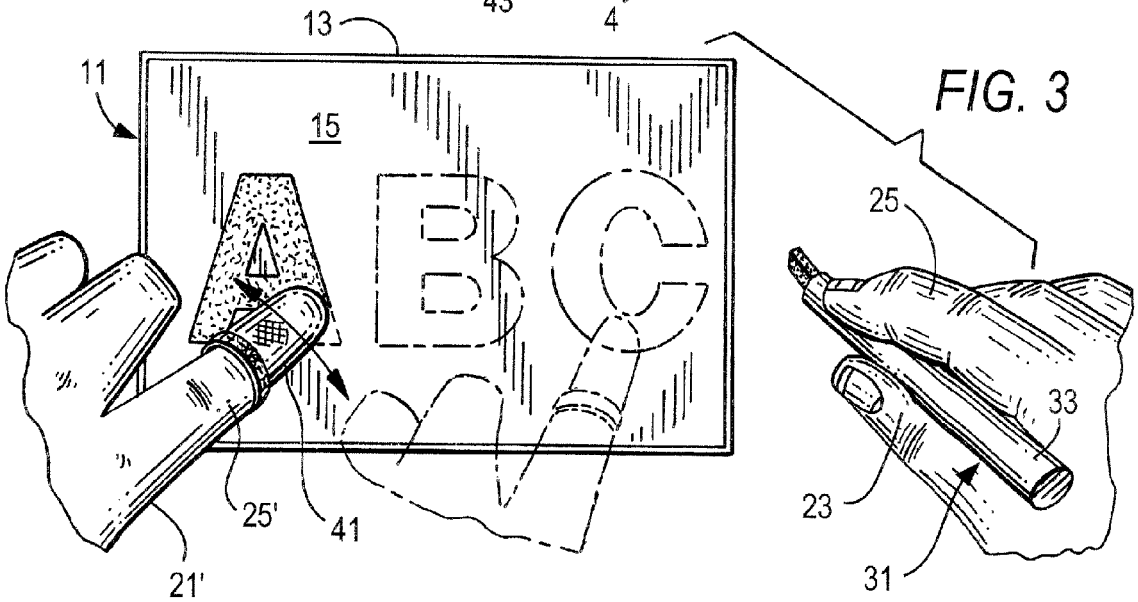
FIG. 3 is an exploded perspective view showing a worn finger eraser of the invention being used to erase the letter markings that were previously written on the white board.
Figure 4:
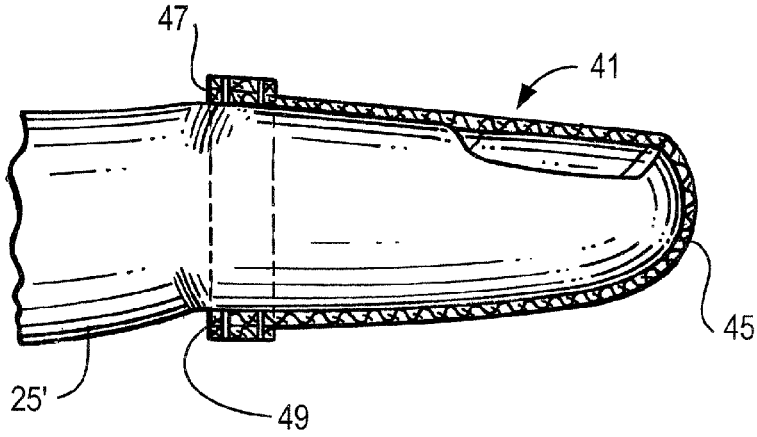
FIG. 4 is a side view in partial cross section showing the finger eraser of the invention being worn on the index finger of the user's non-dominant hand.

Referring first to FIGS. 2 and 4, a finger eraser made in accordance with the invention is shown. The finger eraser comprises a form-fitted fully flexible finger element 41 made from a knitted or felted fabric. The knitted or felted fabric may have a soft pile construction and is made from fibers selected from both man made fibers and natural fibers. Suitable man made fibers include cellulosic fiber and non-cellulosic fibers, the latter including nylon, polyester and acrylic. Suitable natural fibers include wool and cotton.

Finger element 41 includes a tubular portion 43 having a closed end 45 and an open end 47. Open end 47 is sized such that an individual's index or other finger can be inserted therethrough so that at least a portion of the finger is received within and covered by tubular portion 43 of finger element 41. Preferably, open end 47 of finger element 41 is formed with an annular elastic member or band 49 for preventing finger element 41 from detaching from one's finger while being worn.

Figure 1:
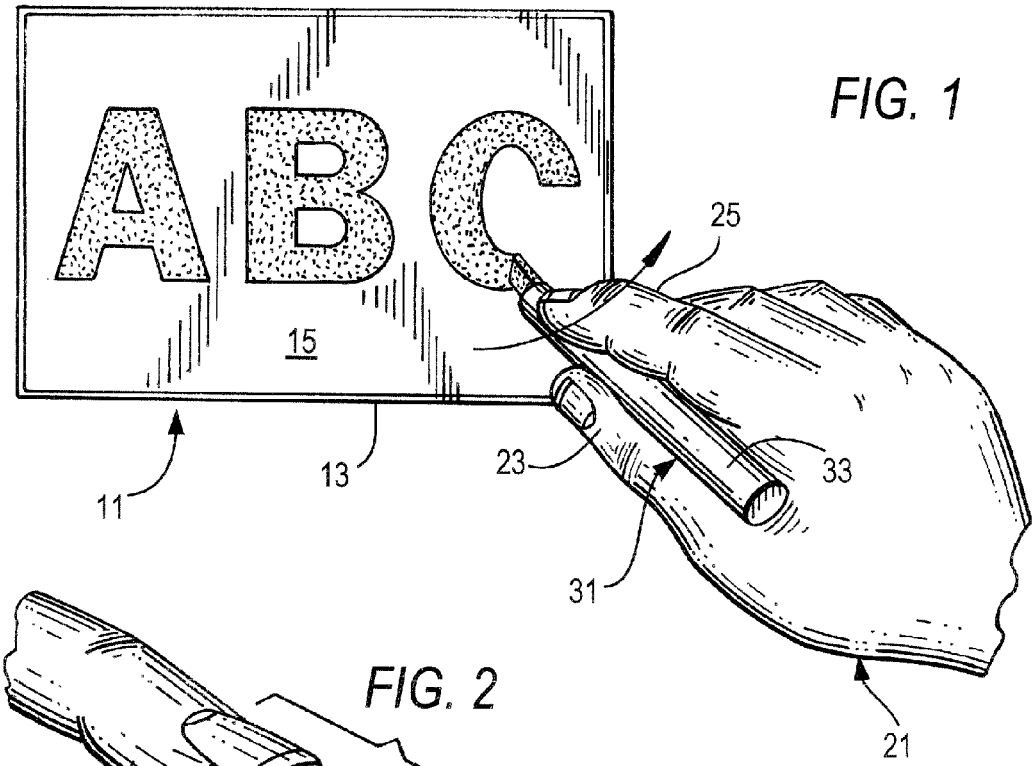
FIG. 1 is a perspective view showing letter markings being written on a white board by means of an erasable marker being held in the dominant hand of a user.

Finger element 41 is shown being used in conjunction with an erasable white board 11 defined by a frame 13 and having a writing surface 15. As is well known in the art, an individual may use an erasable marker 31 to write or draw a desired marking or markings along surface 15 of board 11, such as the letters A-B-C, as shown in FIG. 1. Marker 31 includes a body 33, a writing tip 35 extending from one end of body 33 and a cover 37 (see FIG. 5) which may be selectively placed over one end of body 33 in order to protect tip 35 and otherwise prevent tip 35 from drying out. Optionally, cover 37 will include a longitudinally extending clip 39 to be used in securing marker 31 to a desired item (see FIG. 5 as well).

When writing or drawing along surface 15 of white board 11, cover 37 of marker 31 is first removed. The user then holds marker 31 in his or her dominant or writing hand by grabbing marker 31 with thumb 23 and index finger 25, as shown in FIG. 1.

At the same time, and as shown in FIG. 2, finger element 41 is placed over index finger 25 of the non-dominant or non-writing hand. Thus, the dominant hand of the user is holding marker 31, while the index or other finger of the non-dominant hand of the user is wearing finger element 41. As such, the user can selectively write or draw along surface 15 of board 11 and instantly erase what is written or drawn, without having to put down marker 31 or otherwise retrieve a suitable eraser element. In other words, finger element 41 may be used to erase what has been written or drawn along the surface 15 of board 11 without requiring a transfer of any eraser element from one hand to the other, or the retrieval of an eraser element from a storage surface or other location.

Figure 5:
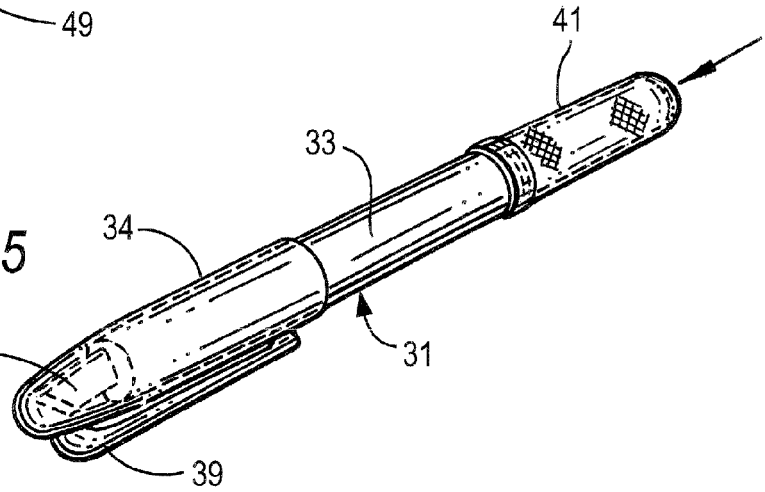
FIG. 5 is a perspective view showing the finger eraser of the invention being located on the end of the marker for storage purposes.
Figure 6:
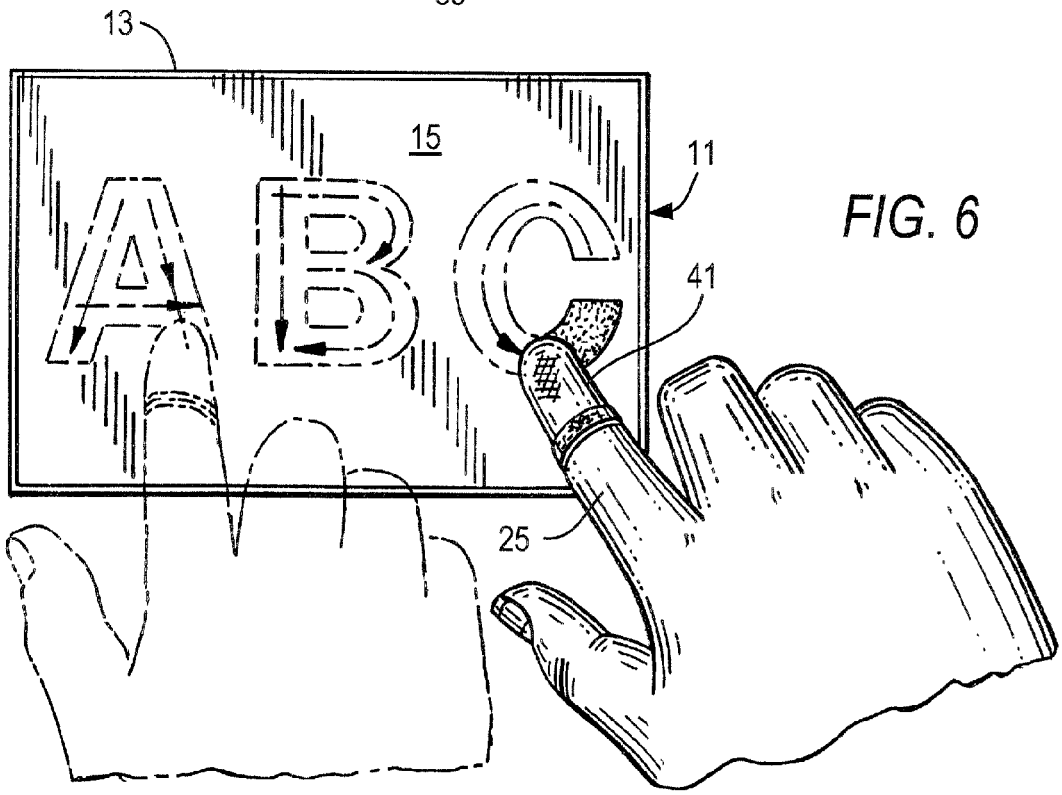
FIG. 6 is a front perspective view showing use of the inventive finger eraser of the invention on the index finger of the dominant hand in tracing over the letter markings that had been written on the white board.

When finger element 41 is not being used in erasing markings along surface 15 of board 11, finger element 41 may be stored along the end of marker 31 that is opposite to the end from which tip 35 extends (see FIG. 5). This prevents the finger eraser of the invention from being lost.

In addition, finger element 41 may be worn along the index finger 25 or other finger of the dominant or writing hand of the user. In this manner, finger eraser 41 can provide instructional value to the user. The user can trace/erase over the letters or words written on the white board 11, thus providing multi-sensory instruction, something which is especially beneficial for students who are struggling in the classroom.

The inventive finger eraser is illustrated by example in the drawing figures, and throughout the written description. It should be understood, however, that numerous variations are possible, while still adhering to the inventive concept. Such variations are contemplated as being a part of the present invention.

The scope of the invention will now be set forth in the following claims.

The invention claimed is:

1. An educational writing system for a student comprising:

a board;

at least one writing implement for writing or drawing markings on said board; and an eraser for removing said markings from said board, said eraser including only one form-fitted finger element sized and shaped to fit on the finger of a student, said finger element being made from a fabric forming a continuous tubular member for defining a longitudinally extending finger passage, the tubular member having a first open end and a second closed end, the first open end being sized such that a finger of said student is insertable therethrough so that at least a portion of said finger is received within said passage with the tip of the finger being disposed at said closed end to perform said removing.

2. The system of claim 1, wherein said open end of said tubular member is formed with an annular elastic element to facilitate prevention of said finger element from sliding off said finger when said at least a portion of said finger is received within said finger element passage.

3. The system of claim 1, wherein said fabric is made from fibers selected from the group consisting of man-made fibers and natural fibers.

4. The system of claim wherein 1 said board is a white board.

5. The system of claim 4 wherein said writing implement is a marker with a tip generating said marking by depositing an ink on said white board.

6. The system of claim 1 wherein said board is a chalk board.

7. The system of claim 1 wherein said fabric is a knitted or felt fabric.

8. The system of claim 7, wherein said knitted or felted fabric is made from fibers selected from the group consisting of man-made fibers and natural fibers.

9. The system of claim 8, wherein said man-made fibers are selected from the group consisting of cellulosic fibers and non-cellulosic fibers.

10. The system of claim 8, wherein said man-made fibers are non-cellulosic fibers selected from the group consisting of nylon, polyester and acrylic.

11. The system of claim 8, wherein said natural fibers are selected from the group consisting of wool and cotton.

12. The system of claim 1 wherein said eraser is a cutoff finger portion of a glove.

13. A method for erasing markings written or drawn on a board, including chalk boards and white boards, by a user having a hand with a finger, the method comprising:

obtaining an eraser including only one fitted finger element made from a knitted or felted fabric, the finger element including a tubular member for defining a longitudinally extending continuous finger passage, the tubular member having an open end and a closed end;

placing said finger element over said finger such that at least a portion of said finger is received in said finger passage with the tip of the finger disposed inside the closed end; and pressingly running said closed end of said finger element on said board and along said markings to erase at least a portion of said markings.

14. An assembly comprising:

a pen having a writing end adapted to make markings on a board and another end opposite said writing end; and a finger eraser having only one tubular body made of an elastic fabric adapted to selectively be mounted on said another end for storage or carrying; and to be removed from said opposite end and be mounted on a finger, with said tubular body having a closed end, and being shaped and sized so that when the finger is inserted into said finger eraser, the finger tip reaches the closed end to selectively erase said markings.

* * * * *